US006131624A

United States Patent [19]

Paradies

[11] Patent Number: 6,131,624

[45] Date of Patent: Oct. 17, 2000

[54] FILLING VALVE ASSEMBLY

[75] Inventor: Gilbert E. Paradies, Satellite Beach, Fla.

[73] Assignee: Crown Simplimatic Incorporated, Lynchburg, Va.

[21] Appl. No.: 09/302,771

[22] Filed: Apr. 30, 1999

Related U.S. Application Data

[60] Provisional application No. 60/116,309, Jan. 19, 1999, and provisional application No. 60/117,612, Jan. 28, 1999.

[51] Int. Cl.[7] ..... B65B 1/04

[52] U.S. Cl. ..... 141/286; 141/39; 141/302

[58] Field of Search ..... 141/39–49, 286, 141/290, 301, 302, 305, 309

[56] References Cited

U.S. PATENT DOCUMENTS

| | | |
|---|---|---|
| 2,467,683 | 4/1949 | Meyer . |
| 2,467,684 | 4/1949 | Meyer et al. . |
| 2,617,575 | 11/1952 | Mojonnier . |
| 3,212,537 | 10/1965 | Hinxlage et al. . |
| 3,385,327 | 5/1968 | Granier . |
| 3,500,879 | 3/1970 | Meyer . |
| 3,799,219 | 3/1974 | Uth et al. . |
| 3,804,133 | 4/1974 | Copping . |
| 3,834,428 | 9/1974 | Rademacher . |
| 4,159,726 | 7/1979 | Mette . |
| 4,349,055 | 9/1982 | DiChiara . |
| 4,387,748 | 6/1983 | White . |
| 4,442,873 | 4/1984 | Yun . |
| 4,586,548 | 5/1986 | Hinxlage . |
| 4,688,608 | 8/1987 | Puskarz et al. . |
| 4,750,533 | 6/1988 | Yun . |
| 4,938,261 | 7/1990 | Petri et al. . |
| 4,986,318 | 1/1991 | Yun . |
| 5,060,702 | 10/1991 | LaWarre, Sr. et al. . |
| 5,125,440 | 6/1992 | Mettte . |
| 5,139,058 | 8/1992 | Yun . |
| 5,141,035 | 8/1992 | Nish et al. . |
| 5,145,008 | 9/1992 | Yun . |
| 5,150,740 | 9/1992 | Yun . |
| 5,156,200 | 10/1992 | Mette . |
| 5,163,487 | 11/1992 | Clusserath . |
| 5,329,963 | 7/1994 | Jones et al. . |
| 5,445,194 | 8/1995 | Clusserath . |
| 5,474,113 | 12/1995 | Rademacher et al. . |
| 5,564,481 | 10/1996 | Clusserath . |
| 5,749,403 | 5/1998 | Conforti . |

*Primary Examiner*—Steven O. Douglas
*Attorney, Agent, or Firm*—Howard & Howard

[57] ABSTRACT

A filling valve assembly for filling a beverage container with a liquid beverage. The valve assembly includes a valve body having an outer wall and a vent tube for ventilating the container when the container is filled with the liquid. Fluid passageways are defined between the outer wall and the vent tube for allowing the liquid to discharge into the container. A notch is formed within the outer wall and a screen is disposed across the fluid passageway with an outer diameter extending into the notch. The valve assembly is characterized by the notch being a truncated cone extending axially in the direction of the fluid passageway to define an angled surface for facilitating disposition of the screen into the notch and within the fluid passageway. The assembly is also characterized by the screen having a chemically etched surface creating a plurality of square holes within the screen for preventing unnecessary dripping of fluid material into the container. In addition, a deflector is provided wherein the deflector extends across the fluid passageway for deflecting the fluid material toward the side of the container. The valve assembly is further characterized by the deflector being fixedly secured to the valve body such that the deflector remains adjacent to the fluid passageway and extends entirely across the fluid passageway during the discharge of fluid material into the container.

44 Claims, 4 Drawing Sheets

FIG - 3
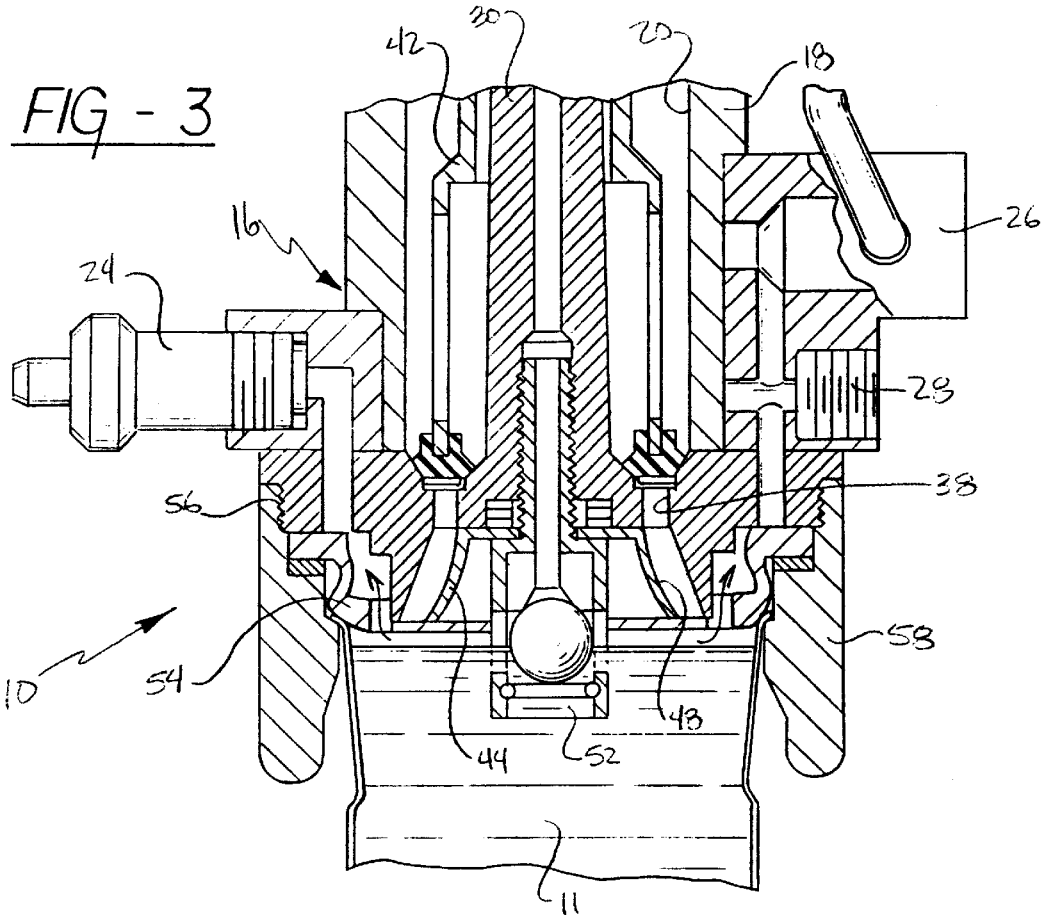
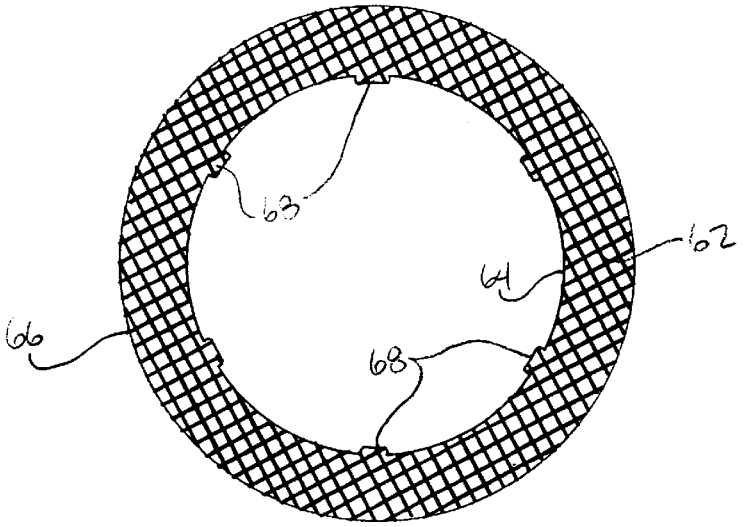
FIG - 8

FILLING VALVE ASSEMBLY

RELATED APPLICATIONS

This patent application claims priority to and all the benefits of U.S. Provisional Patent Application Ser. No. 60/116,309 filed on Jan. 19, 1999 and entitled "Valve Body Assembly For a Beverage Filling Machine" and to U.S. Provisional Patent Application Ser. No. 60/117,612 filed on Jan. 28, 1999 and entitled "Valve Body Assembly For a Beverage Filling Machine".

BACKGROUND OF THE INVENTION

1) Technical Field

The subject invention relates filling valve bodies for use in beverage filling machines.

2) Description of the Prior Art

Beverage filling machines used for filling containers, such as cans, jars, or bottles, with a beverage, such as carbonated drinks, juices, water or the like, as are well known in the art. Conventional filling machines feed the containers into a star wheel conveyor which individually positions each container on a rotating turntable below a filling valve assembly. The container moves into sealing engagement with the valve assembly by either moving the container upwardly or by lowering the valve assembly. There may be as many as 120 individual valve assemblies disposed circumferentially around the turntable. The methods and apparatuses for filling the containers with the carbonated liquids have evolved into counter pressure filling machines. These counter pressure filling machines typically operate under relatively high pressures.

In a typical filling operation, the container, which is sealed against the valve assembly, is initially purged with an inert gas for a predetermined time in order to flush air and other impurities from the container. The liquid beverage is then filled into the container through a number of fluid passageways while the gas from the container vents through a vent tube. In order to reduce foaming and splashing of the liquid, the liquid beverage is frequently directed toward the outer walls of the container. This process continues until the container is filled with the liquid. As appreciated, the valves assemblies are designed to prevent leakage of the pressurized liquid when the container is not present.

The beverage filling industry continuously strives for machinery and methods which facilitate rapid, economical, efficient, and sterile filling of containers. Some deficiencies have evolved, however, with respect to some parts within conventional filling valve assemblies.

One such deficiency relates to a screen which is mounted within the fluid passageway. Current screen designs are woven screens of small pieces of wire. One of the wires may become loose or even fall out into the container during the filling process. In addition, the woven screens are typically press fit into a groove formed within the filling valve. Once press fit, the woven screen frequently bends and creates a humped portion in the middle thereof. These woven screens are typically mounted near a sealing device of the filling valve wherein the humped portion and/or the loose wires may interfere with the sealing device. In addition, the humped portion and/or loose wires may damage the sealing device and/or prevent an effective sealing engagement. If the sealing device is damaged or does not effectively seal against the filling valve, leakage of liquid material may result. Hence, it is desirable to incorporate a screen which does not suffer from the deficiencies outlined above.

Another deficiency relates to how the fluid material is directed toward the outer walls of the container. The prior art has contemplated the use of deflectors for directing the flow of liquid material. Examples of these prior art deflectors are shown in U.S. Pat. Nos. 2,467,683; 2,467,684; 3,212,537; and 4,349,055. These deflectors, however, are all mounted to moveable vent tubes which reduces the effectiveness of the deflectors. As the deflectors move farther and farther away from the fluid passageways, the fluid material may not be effectively deflected to the side walls of the container. Accordingly, it is desirable to incorporate a deflector which continuously directs the flow of fluid material to the outer walls of the container.

SUMMARY OF THE INVENTION AND ADVANTAGES

A filling valve assembly for filling a container with a fluid material. The filling valve assembly comprises a valve body having an outer wall defining an inner chamber. A vent tube extends upwardly through the chamber for ventilating the container when the container is filled with the fluid material and defines at least one fluid passageway disposed between the outer wall and the vent tube for allowing the fluid material to discharge from the chamber and into the container. A notch extends laterally into one of the outer wall and the vent tube. A screen is disposed across the fluid passageway and has an inner diameter and an outer diameter with one of the diameters extending into the notch. The valve assembly is characterized by the notch being a truncated cone extending axially in the direction of the fluid passageway to define an angled surface for facilitating disposition of the screen into the notch and within the fluid passageway. The assembly is also characterized by the screen having a chemically etched surface creating a plurality of holes within the screen for preventing unnecessary dripping of fluid material into the container.

In addition, a deflector having an outwardly curved surface may be provided wherein the deflector extends transversely across the fluid passageway for deflecting the fluid material discharging from the chamber toward a peripheral wall of the container. The valve assembly is further characterized by the deflector being fixedly secured to the valve body such that the curved surface remains adjacent to the fluid passageway and extends entirely across the fluid passageway during the discharge of fluid material into the container.

Accordingly, the subject invention provides a screen which does not suffer from the deficiencies of a woven screen and an angled notch which allows for effective mounting of the screen. Further, the subject invention provides a stationary deflector which continuously deflects the flow of fluid material to the outer walls of the container.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a partially cross-sectional view of the filling valve assembly with the container filled with a fluid material;

FIG. 8 is a detailed view of the screen itself.

DETAILED DESCRIPTION OF THE PREFERRED EMBODIMENT

Figure 1:
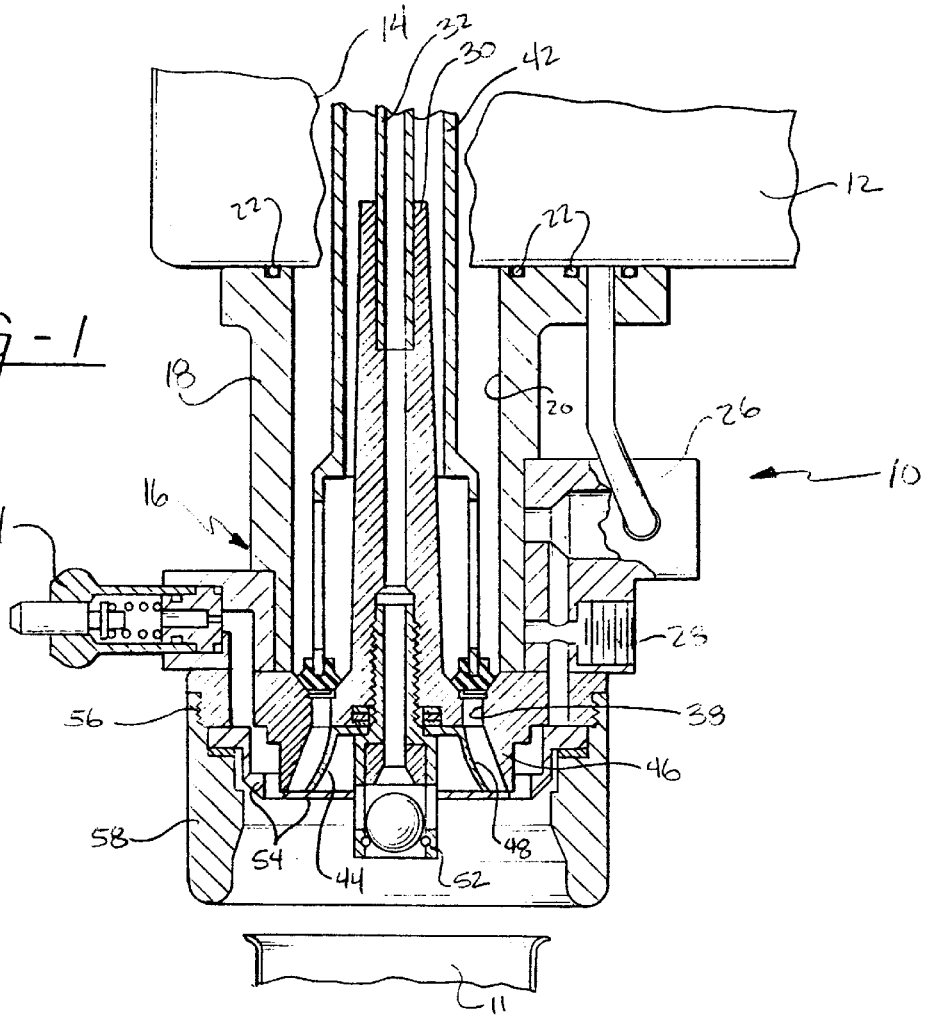
FIG. 1 is a partially cross-sectional view of a filling valve assembly having a container in spaced relationship thereto.
Figure 2:
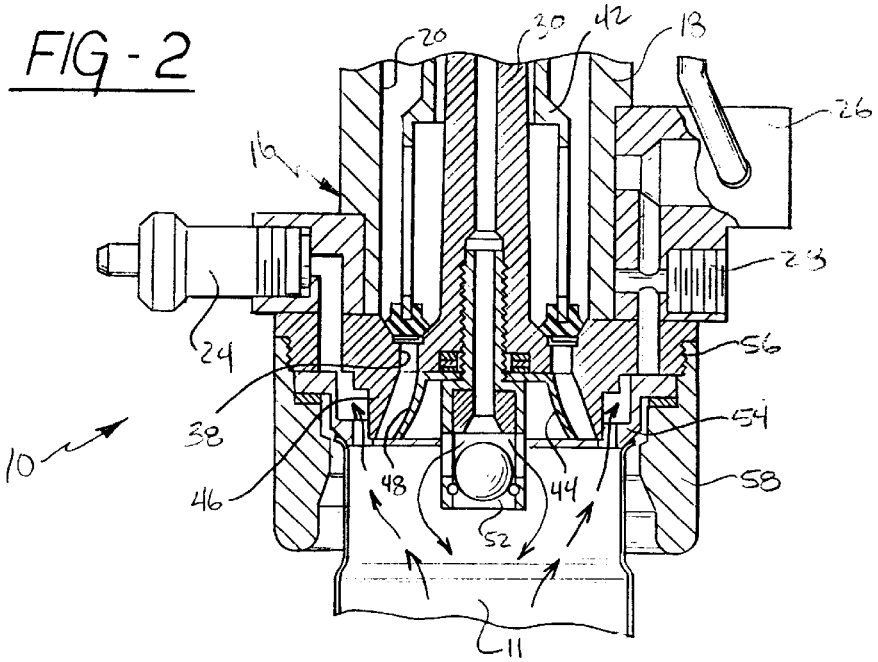
FIG. 2 is a partially cross-sectional view of the filling valve assembly with the container engaging a valve body.

Referring to the Figures, wherein like numerals indicate like or corresponding parts throughout the several views, a filling valve assembly is generally shown at 10 in FIGS. 1 through 3. The filling valve assembly 10 could fill any type of container 11, such as a can, jar or bottle, with any type of fluid material, such as carbonated drinks, juices, water or the like. The filling valve assembly 10 is part of a beverage filling machine which includes a series of conveyors, tanks and support platforms as are well known in the art. As shown in FIG. 1, the filling machine includes a support housing 12 having an inner fluid tank 14 or ring bowl. For illustrative purposes, the support housing 12 and fluid tank 14 are shown schematically. A typical ring bowl has an annular configuration and contains the liquid or beverage material for filling the containers 11. A space is disposed above the liquid for providing a headspace for a pressurized inert gas such as carbon dioxide or nitrogen. A common storage tank or reservoir (not shown) feeds the ring bowl with the required liquid and gas.

Figure 4:
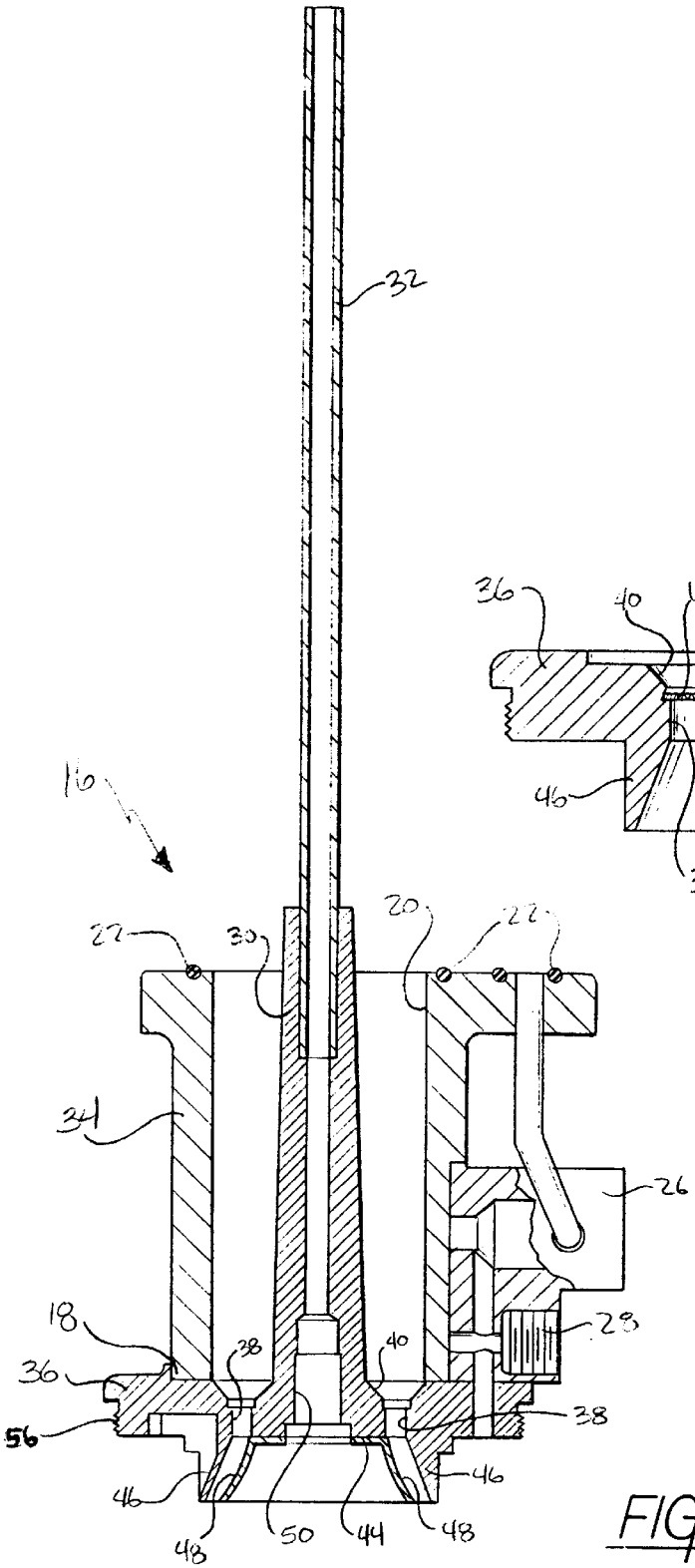
FIG. 4 is a cross-sectional view of the valve body having an outer wall and a vent tube.

The filling valve assembly 10 of the subject invention is now discussed in greater detail with reference to FIGS. 1 through 5. The valve assembly 10 comprises a valve body, generally shown at 16, having an outer wall 18 defining an inner chamber 20. As illustrated in FIG. 4, the valve body is shown in its entirety with few additional parts. The inner chamber 20 is open to the fluid tank 14 within the support housing 12 such that the chamber 20 holds the liquid beverage before dispensing into the container 11. A plurality of seals 22 are mounted to the top of the outer wall 18 of the valve body 16 for sealing engagement with the support housing 12. Additional valve devices, such as shift valves 24 and CIP valves 26, may be mounted to threaded inserts 28 within the outer wall 18 to assist in the operation of the filling machine.

A vent tube 30 extends upwardly through the inner chamber 20 for ventilating the container 11 when the container 11 is filled with the fluid material. Preferably, a vent tube extension 32 extends upwardly from the vent tube 30. The vent tube 30 may be of a unitary design or may be formed of multiple parts as shown.

Figure 5:
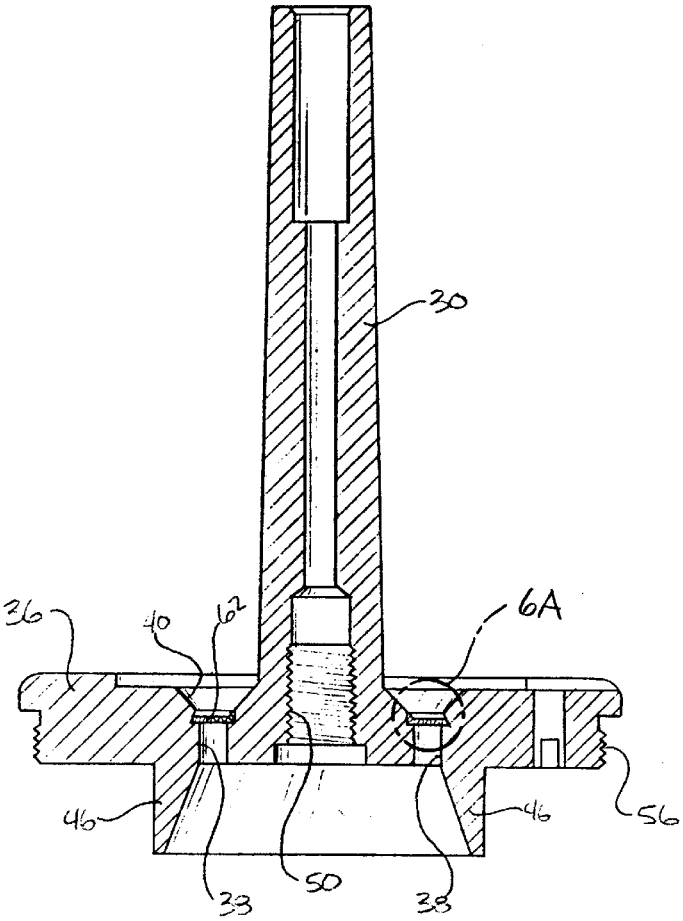
FIG. 5 is a cross-sectional view of the vent tube and a portion of the outer wall.

As best illustrated in FIGS. 4 and 5, the outer wall 18 is preferably formed in two separate portions 34, 36. Specifically, the outer wall 18 has an upper portion 34 and a lower portion 36. The upper portion 34 substantially forms the wall for defining the inner chamber 20 and the lower portion 36 is integrally formed with the vent tube 30. The upper portion 34 of the outer wall 18 is separately machined and then fixedly welded to the lower portion 36. As appreciated, the portions 34, 36 of the outer wall 18 and the vent tube 30, as well as the threaded inserts 28, may be machined from a single piece of metal in order to eliminate the need for welding the portions 34, 36 together. As illustrated in FIG. 5, the upper portion 34 of the outer wall 18, which includes the threaded inserts 28, is removed from the lower portion 36 of the outer wall 18 and the vent tube 30.

At least one fluid passageway 38 is defined between the outer wall 18 and the vent tube 30 for allowing the fluid material to discharge from the inner chamber 20 and into the container 11. Preferably, the fluid passageway 38 is formed between the lower portion 34 of the outer wall 18 and the vent tube 30. Even more preferably, there are a number of fluid passageways 38, such as four, each extending arcuately around the vent tube 30 below the chamber 20. Although not shown, the fluid passageways 38 have a curved oval configuration as is known in the art. The fluid passageways 38 span a majority of the circumference of the vent tube 30. As appreciated, there may be any number of passageways having any type of configuration so long as the fluid material can adequately flow from the inner chamber 20 into the container 11.

A sealing surface 40 is disposed above each of the fluid passageways 38. Preferably, the sealing surface 40 flares outwardly in a frustoconical configuration. A sealing device 42 is movably mounted relative to the valve body 16 for selectively engaging the sealing surface 40 to control the discharge of fluid material into the container 11. Specifically, the sealing device 42 includes a seal (not numbered) for selective engagement with the sealing surface 40 thereby effectuating the sealing engagement with the fluid passageways 38. A control device (not shown) controls the selective engagement of the sealing device 42 with the sealing surface 40. The movement of the control device and sealing device 42 control the flow of fluid material from the fluid tank 14 and inner chamber 20 into the container 11. The sealing device 42 and control device may be of any suitable design as is well known in the art.

Referring to FIGS. 1 through 4, a deflector 44 is fixedly secured to the valve body 16. The deflector 44 has an outwardly curved surface extending transversely across the fluid passageway 38 for deflecting the fluid material discharging from the inner chamber 20 toward a peripheral wall or side of the container 11. The valve assembly 10 is characterized by the deflector 44 being fixedly secured to the valve body 16 such that the curved surface remains adjacent to the fluid passageway 38 and extends entirely across the fluid passageway 38 during the discharge of fluid material into the container 11.

An outlet flange 46 extends downwardly from the outer wall 18 and has inner and outer surfaces with the inner surface angling outwardly from the fluid passageway 38. The deflector 44 curves outwardly toward the inner surface of the flange 46 to define an angled or curved channel 48 between the deflector 44 and the flange 46. In other words the curved channel 48 extends the fluid passageway 38 to the distal end of the flange 46. This flange 46 and deflector 44 configuration is known in the art as a tipless valve design. As appreciated by those skilled in the art, the liquid beverage must flow down the peripheral or outside walls of the container 11 in order to eliminate splashing and foaming of the liquid material. The outwardly curved surface further assists in directing the flow of liquid material to the peripheral walls of the container 11.

In order to have the flow of fluid operate effectively, the curved channel 48 formed between the deflector 44 and flange 46 must not be greater than the fluid passageway 38 formed between the lower portion 34 of the outer wall 18 and vent tube 30. Specifically, the fluid passageway 38 has a first width and the channel 48 has a second width with the first width being preferably equal to or greater than the second width. In other words, the curved channel 48 must have an equal or smaller width than the fluid passageways 38. The smaller, or equal, width curved channel 48 helps ensure that there is a minimal amount of foaming and splashing from the liquid. Of course the deflector 44 may have any suitable curved design so long as the above parameters are achieved.

The vent tube 30 includes a threaded portion 50, illustrated best in FIGS. 4 and 5, with a ball cage 52 threadingly engaging the threaded portion 50 of the vent tube 30. The deflector 44 is wedged between the ball cage 52 and the vent tube 30 such that the ball cage 52 fixedly mounts the deflector 44 to the valve body 16. Specifically, the ball cage 52 extends through the center of the deflector 44 to secure the deflector 44 to the valve body 16 immediately below the vent tube 30. As appreciated, the ball cage 52 is provided for this particular type of counter pressure filling machine and may be replaced by any suitable attachment device so long as the deflector 44 is secured to the valve body.

A container seal 54 is disposed about the outer surface of the outlet flange 46 for sealing the container 11 to the valve body 16 when the container 11 is filled with fluid material. The outer wall 18 also has a number of threads 56 wherein a sleeve 58 may be threaded onto the valve body 16. The container seal 54 is wedged between the valve body 16 and the sleeve 58. The design of this valve body 16 requires a specific container seal configuration which is disclosed and claimed in U.S. Pat. Nos. 4,750,533; 4,986,318; and 5,145,008.

Referring to FIGS. 1 through 3, a typical filling operation is now discussed in detail. Initially, the container 11 is spaced from the filling valve assembly 10 as shown in FIG. 1. The sealing mechanism seals the fluid passageways 38 such that no liquid material drips or leaks from the inner chamber 20. The container 11 then moves into sealing engagement with the container seal 54 as shown in FIG. 2. The container 11 is then purged with the inert gas from the ring bowl for a predetermined time in order to flush air and other impurities from the container 11. The purging by the inert gas is illustrated by the arrows. The inert gases passes through the vent tube 30 around the ball cage 52 and into the container 11.

The liquid is then filled into the container 11 from the ring bowl while the gas from the container 11 vents through the vent tube 30 into the headspace. The gas pressure in the container 11 and the ring bowl are equalized when filling begins. This is what is known as counter pressure which allows the liquid to flow into the container 11 solely under the influence of gravity. In order to reduce foaming and splashing of the liquid, the liquid material is directed toward the sides of the container 11 by the deflector 44. This filling process continues until the container 11 is filled with the liquid as shown in FIG. 3. The container 11 is now wedged between the container seal 54 and the sleeve 58. In addition, the ball within the ball cage 52 has moved upward to block the air passageway into the vent tube 30. Gas is then released from the top of the container 11 to the atmosphere through the snift valve 24 by an process commonly known as "snifting". The filled container 11 is then lowered and passed to a capping station as is known in the art.

Referring now to FIGS. 5 through 6A and 8, other novel aspects of the valve body are shown in greater detail. Specifically, a notch 60 extends laterally into one of the outer wall 18 and the vent tube 30. Preferably, the notch 60 is formed within the outer wall 18 of the valve body 16. Even more preferably, the notch 60 is formed within the lower portion 34 of the outer wall 18. The valve assembly 10 is characterized by the notch 60 being a truncated cone extending axially in the direction of the fluid passageway 38 to define an angled surface. A screen 62 is disposed across the fluid passageway 38 and has an inner diameter 64 and an outer diameter 66 with one of the diameters 64, 66 extending into the notch 60. The angled surface facilitates disposition of the screen 62 into the notch 60 and within the fluid passageway 38. As discussed above, the notch 60 is formed within the outer wall 18 which in turn locks the outer diameter 66 of the screen 62 to the valve body 16. Preferably, the angled surface of the notch 60 is angled 15° outwardly from the fluid passageway 38 as viewed in cross-section. As appreciated, the notch 60 may be of any size having any suitable angle so long as the screen 62 can be effectively inserted and adequately retained.

As best shown in FIG. 8, the screen 62 includes a plurality of integral tabs 68 formed on at least one of the inner 64 and outer 66 diameters of the screen 62 for locking engagement with the at least one of the outer wall 18 and the vent tube 30. In the preferred embodiment, the tabs 68 are formed along the inner diameter 64 of the screen 62 for locking engagement with the vent tube 30. Specifically, there are six tabs 68 equidistantly formed circumferentially about the inner diameter 64 of the screen 62. As appreciated, there may be any number of tabs 68 having any suitable size mounted on either or both diameters 64, 66.

Figure 6:
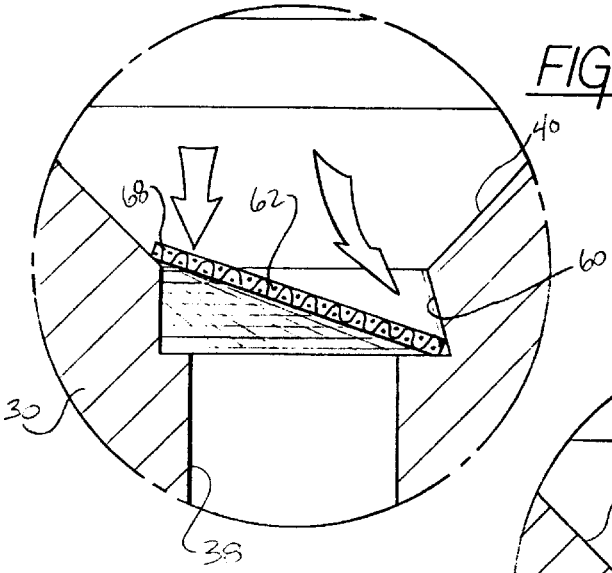
FIG. 6 is an exploded view of the valve body detailing the installation of a screen.
Figure 6A:
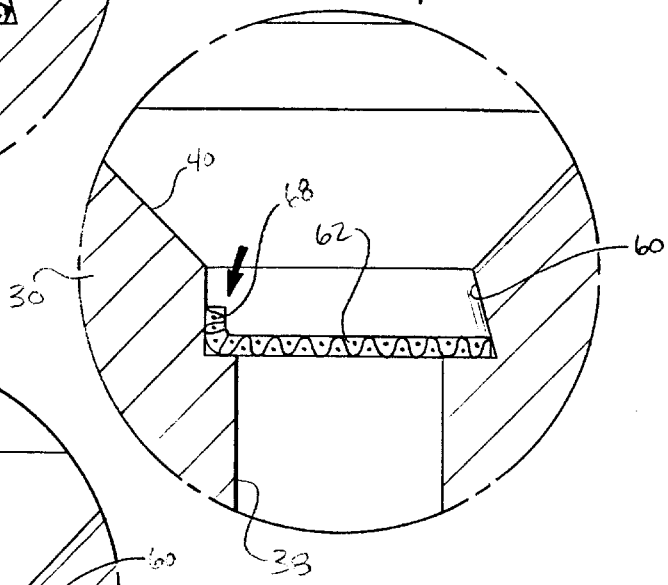
FIG. 6A is an exploded view of the screen mounted within the valve body as shown in FIG. 5.

As illustrated in FIGS. 6 and 6A, the outside diameter 66 of the screen 62 is first snapped into engagement within the notch 60 and then the tabs 68 are wedged against the vent tube 30. In other words, the screen 62 is press fit into position between the vent tube 30 and outer wall 18 and the tabs 68 bend or otherwise deform against a wall of the vent tube 30 to securely lock the screen 62 to the valve body 16. Due to the tight tolerances between the outer wall 18 and the vent tube 30, a tool (not shown) may be used to install the screen 62. As appreciated, the screen 62 may also be removed from the locking engagement within the notch 60 and against the vent tube 30 for service and/or replacement.

The screen 62 of the subject invention is non-woven and accordingly does not suffer from the deficiencies of a woven screen design. As discussed in the background section, some deficiencies of woven screen designs include the potential for loose wires which can drop into the container being filled, woven screens have a tendency to bend or buckle, and woven screens can cause the liquid seal to leak if not properly seated.

The filling valve assembly 10 is also characterized by the screen 62 having a chemically etched surface creating a plurality of holes within the screen 62 for preventing unnecessary dripping of fluid material into the container 11. Specifically, the screen 62 is made from a single sheet of metal, preferably stainless steel. The etching of the holes is created by placing a template over the screen 62 and then depositing an acid or other suitable chemical on the screen 62. The chemical dissolves the exposed part of the screen 62 to create the chemically etched surface with the holes. Preferably, the holes in the screen 62 have a substantially square configuration. As appreciated by those skilled in the art, the open area, or holes, of the screen 62 is an important design feature. Although the shape of the holes, i.e., square, round, triangular, etc., is not as important. One primary purpose of the screen 62 is to hold the liquid material after the filling process is completed. Dripping and product loss can be reduced if the screen 62 operates effectively. An effectively operating screen 62 creates a liquid surface tension between the screen 62 and the liquid material. The liquid surface tension operates to hold the liquid material within the holes of the screen 62. As appreciated, if the holes in the screen 62 are too large or too numerous, then the liquid surface tension will not be created and drippage will result. It is desirable to have the maximum open area possible without losing the ability of the screen 62 to hold liquid. The screen 62 of the subject invention is created to very tight tolerances which maximizes the open area while still maintaining adequate liquid surface tension.

It is also desirable to have the screen 62 located as close to the sealing point as possible to further minimize any dripping. The screen 62 of the subject invention is mounted immediately below the liquid sealing surface 40 near the top of the fluid passageways 38. This places the screen 62 as close to the sealing point as possible.

Figure 7:
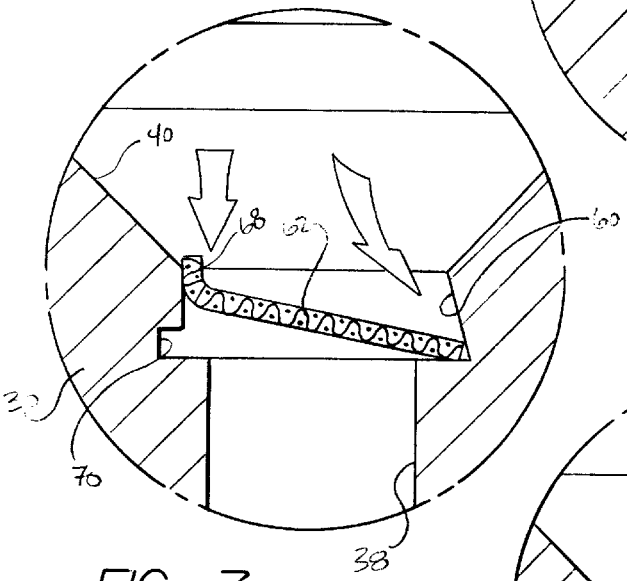
FIG. 7 is an alternative embodiment of the valve body detailing an alternative mounting of the screen.
Figure 7A:
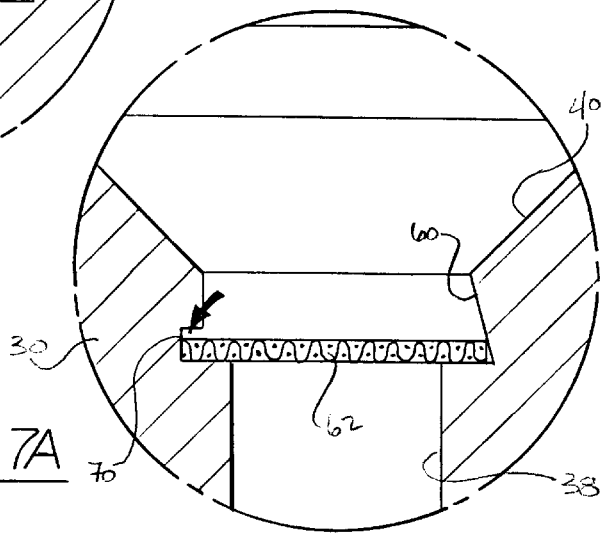
FIG. 7A is an exploded view of the screen mounted within the alternative embodiment of the valve body of FIG. 7.

Referring to the alternative embodiment of FIGS. 7 and 7A, a groove 70 is formed within the vent tube 30 across from the notch 60 for locking engagement with the tabs 68 extending from the inner diameter 64 of the screen 62. Preferably, the groove 70 extends around the entire circumference of the vent tube 30. During installation of the screen 62, the outer diameter 66 will first be locked into the notch 60 and then the tabs 68 on the inner diameter 64 are snapped into the grooves 70.

The invention has been described in an illustrative manner, and it is to be understood that the terminology which has been used is intended to be in the nature of words of description rather than of limtitation. It is now apparent to those skilled in the art that many modifications and variations of the present invention are possible in light of the above teachings. It is, therefore, to be understood that within the scope of the appended claims the invention may be practiced otherwise than as specifically described.

What is claimed is:

1. A filling valve assembly for filling a container with a fluid material, said assembly comprising;

a valve body having an outer wall defining an inner chamber;

a vent tube extending upwardly through said chamber for ventilating the container when the container is filled with the fluid material and defining at least one fluid passageway disposed between said outer wall and said vent tube for allowing the fluid material to discharge from said chamber and into the container;

a notch extending laterally into one of said outer wall and said vent tube; and a screen disposed across said fluid passageway and having an inner diameter and an outer diameter with one of said diameters extending into said notch;

said assembly characterized by said notch being a truncated cone extending axially in the direction of said fluid passageway to define an angled surface for facilitating disposition of said screen into said notch and within said fluid passageway.

2. An assembly as set forth in claim 1 wherein said notch is formed within said outer wall of said valve body for locking said outer diameter of said screen to said valve body.

3. An assembly as set forth in claim 2 wherein said angled surface of said notch is angled 15° outwardly from said fluid passageway as viewed in cross-section.

4. An assembly as set forth in claim 1 further including a plurality of integral tabs formed on at least one of said inner and outer diameters of said screen for locking engagement with said at least one of said outer wall and said vent tube.

5. An assembly as set forth in claim 4 wherein said tabs are formed along said inner diameter of said screen for locking engagement with said vent tube.

6. An assembly as set forth in claim 5 wherein six tabs are equidistantly formed circumferentially about said inner diameter of said screen.

7. An assembly as set forth in claim 5 wherein said notch is formed within said outer wall of said valve body for locking said outer diameter of said screen to said valve body.

8. An assembly as set forth in claim 7 further including a groove formed within said vent tube across from said notch for locking engagement with said tabs extending from said inner diameter of said screen.

9. An assembly as set forth in claim 8 wherein said screen is formed of stainless steel.

10. An assembly as set forth in claim 9 further including a plurality of holes chemically etched into said screen.

11. An assembly as set forth in claim 10 wherein said holes in said screen have a substantially square configuration.

12. An assembly as set forth in claim 1 including a sealing surface disposed above said fluid passageways and flared outwardly in a frustoconical configuration.

13. An assembly as set forth in claim 12 further including a sealing device movably mounted relative to said valve body for selectively engaging said sealing surface to control said discharge of fluid material into the container.

14. An assembly as set forth in claim 13 further including a support housing defining an inner fluid tank for supplying the fluid material to be discharged into the container.

15. An assembly as set forth in claim 14 further including a plurality of seals mounted to said valve body for sealing engagement with said support housing.

16. An assembly as set forth in claim 1 further including a deflector fixedly secured to said valve body with said deflector having an outwardly curved surface extending transversely across said fluid passageway for deflecting the fluid material discharging from said chamber toward a peripheral wall of the container.

17. An assembly as set forth in claim 16 further including an outlet flange extending downwardly from said outer wall and having inner and outer surfaces with said inner surface angling outwardly from said fluid passageway.

18. An assembly as set forth in claim 17 wherein said deflector curves outwardly toward said inner surface of said flange to define an angled channel between said deflector and said flange.

19. An assembly as set forth in claim 18 wherein said fluid passageway has a first width and said angled channel has a second width with said first width being equal to or greater than said second width.

20. An assembly as set forth in claim 19 further including a container seal disposed about said outer surface of said outlet flange for sealing the container to the valve body when the container is filled with fluid material.

21. A filling valve assembly for filling a container with a fluid material, said assembly comprising:

a valve body having an outer wall defining an inner chamber;

a vent tube fixedly secured to said valve body and extending upwardly through said chamber for ventilating the container when the container is filled with the fluid material and defining at least one fluid passageway disposed between said outer wall and said vent tube for allowing the fluid material to discharge from said chamber into the container;

a deflector being fixedly secured to said vent tube and extending transversely across said fluid passageway, said deflector having an outer surface arcuatly curved from a first end abutting said vent tube to a second distal end, said arcuate curved outer surface remaining adjacent said fluid passageway during said discharge of fluid material into the container for uniformly deflecting the fluid material discharging from said chamber toward a peripheral wall of the container and;

a ball cage secured to said vent tube with said deflector wedged between said ball cage and said vent tube such that said ball cage fixedly mounts said deflector to said valve body.

22. An assembly as set forth in claim 21 further including an outlet flange extending downwardly from said outer wall and having inner and outer surfaces with said inner surface angling outwardly from said fluid passageway.

23. An assembly as set forth in claim 22 wherein said deflector curves outwardly toward said inner surface of said flange to define an angled channel between said deflector and said flange.

24. An assembly as set forth in claim 23 wherein said fluid passageway has a first width and said channel has a second width with said first width being equal to or greater than said second width.

25. An assembly as set forth in claim 24 further including a container seal disposed about said outer surface of said outlet flange for sealing the container to the valve body when the container is filled with fluid material.

26. An assembly as set further in claim 21 wherein said vent tube includes a threaded portion.

27. An assembly as set forth in claim 26 wherein said ball cage threadingly engages said threaded portion of said vent tube.

28. An assembly as set forth in claim 21 further including a notch extending laterally into one of said outer wall and said vent tube.

29. An assembly as set forth in claim 28 further including a screen disposed across said fluid passageway and having an inner diameter and an outer diameter with one of said diameters extending into said notch.

30. An assembly as set forth in claim 29 wherein said notch is a truncated cone extending axially in the direction of said fluid passageway for facilitating disposition of said screen into said notch and within said fluid passageway.

31. An assembly as set forth in claim 30 wherein said notch is formed within said outer wall of said valve body for locking said outer diameter of said screen to said valve body.

32. An assembly as set forth in claim 31 further including a plurality of integral tabs formed on at least one of said inner and outer diameters of said screen for locking engagement with said at least one of said outer wall and said vent tube.

33. An assembly as set forth in claim 32 wherein said tabs are formed along said inner diameter of said screen for locking engagement with said vent tube.

34. A filling valve assembly for filling a container with a fluid material, said assembly comprising;

a valve body having an outer wall defining an inner chamber;

a vent tube extending upwardly through said chamber for ventilating the container when the container is filled with the fluid material and defining at least one fluid passageway disposed between said outer wall and said vent tube for allowing the fluid material to discharge from said chamber and into the container;

a notch extending laterally into one of said outer wall and said vent tube; and a screen disposed across said fluid passageway and having an inner diameter and an outer diameter with one of said diameters extending into said notch;

said assembly characterized by said screen having a chemically etched surface creating a plurality of holes within said screen for preventing unnecessary dripping of fluid material into the container.

35. An assembly as set forth in claim 34 wherein said holes in said screen have a substantially square configuration.

36. An assembly as set forth in claim 35 wherein said screen is formed of stainless steel.

37. An assembly as set forth in claim 34 therein said notch is a truncated cone extending axially in the direction of said fluid passageway for facilitating disposition of said screen into said notch and within said fluid passageway.

38. An assembly as set forth in claim 37 wherein said notch is formed within said outer wall of said valve body for locking said outer diameter of said screen to said valve body.

39. An assembly as set forth in claim 38 further including a plurality of integral tabs formed on at least one of said inner and outer diameters of said screen for locking engagement with said at least one of said outer wall and said vent tube.

40. An assembly as set forth in claim 39 wherein said tabs are formed along said inner diameter of said screen for locking engagement with said vent tube.

41. An assembly as set forth in claim 40 further including a deflector fixedly secured to said valve body with said deflector having an outwardly curved surface extending transversely across said fluid passageway for deflecting the fluid material discharging from said chamber toward a peripheral wall of the container.

42. An assembly as set forth in claim 41 further including an outlet flange extending downwardly from said outer wall and having inner and outer surfaces with said inner surface angling outwardly from said fluid passageway.

43. An assembly as set forth in claim 42 wherein said deflector curves outwardly toward said inner surface of said flange to define an angled channel between said deflector and said flange.

44. An assembly as set forth in claim 43 wherein said fluid passageway has a first width and said channel has a second width with said first width being equal to or greater than said second width.

* * * * *